US008789445B1

(12) United States Patent
Hawley, III

(10) Patent No.: US 8,789,445 B1
(45) Date of Patent: Jul. 29, 2014

(54) AIR POWERED NUT RUNNER

(76) Inventor: Charles Burridge Hawley, III, Oak Island, NC (US)

( * ) Notice: Subject to any disclaimer, the term of this patent is extended or adjusted under 35 U.S.C. 154(b) by 239 days.

(21) Appl. No.: 13/464,156

(22) Filed: May 4, 2012

(51) Int. Cl.

| | |
|---|---|
| ***B25B 13/04*** | (2006.01) |
| ***B25B 13/06*** | (2006.01) |
| ***B25B 13/48*** | (2006.01) |
| ***B25B 23/16*** | (2006.01) |
| ***B25B 21/00*** | (2006.01) |

(52) U.S. Cl.
CPC ..... *B25B 21/00* (2013.01)
USPC ..... 81/52; 81/119; 81/124.2

(58) Field of Classification Search
CPC ..... B25B 13/481; B25B 13/06; B25B 13/00; B25B 13/08; B25B 13/48; B25G 1/002; B25G 1/005
USPC ..... 81/52, 120, 124.2, 124.3, 124.7, 119; D8/29
See application file for complete search history.

(56) References Cited

U.S. PATENT DOCUMENTS

| | | | | | |
|---|---|---|---|---|---|
| 2,691,912 | A * | 10/1954 | Jones | 81/124.2 |
| 3,682,023 | A | 8/1972 | Greene, Jr. | |
| 3,772,943 | A | 11/1973 | Itano | |
| 4,765,210 | A | 8/1988 | Mierbach et al. | |
| 5,562,006 | A * | 10/1996 | Pelosi et al. | 81/119 |
| 5,673,976 | A * | 10/1997 | Hillis et al. | 301/58 |
| 6,817,272 | B2 * | 11/2004 | Holland | 81/124.2 |
| 2004/0194585 | A1 * | 10/2004 | Clark | 81/124.2 |
| 2006/0130617 | A1 * | 6/2006 | Mamourian | 81/119 |
| 2008/0216611 | A1 * | 9/2008 | Resnick | 81/124.2 |
| 2009/0178517 | A1 * | 7/2009 | Forrester | 81/124.2 |

* cited by examiner

*Primary Examiner* — David B Thomas
(74) *Attorney, Agent, or Firm* — Harpman & Harpman

(57) ABSTRACT

An air driven nut rotation device to rapidly advance a nut along a threaded rod. An apertured engagement disk is registerable about a nut threadably positioned on a rod. A plurality of radially positioned drive arms extend from said disk providing multiple spaced air impingement surfaces which when driven by a stream of air rapidly rotate the disk and nut engaged thereby advancing it along the threaded shaft in selected directional rotation depending on airstream directional engagement.

6 Claims, 5 Drawing Sheets

AIR POWERED NUT RUNNER

BACKGROUND OF THE INVENTION

1. Technical Field

This invention relates to nut driving tools that are used to engage and rotate a nut on a threaded element.

2. Description of Prior Art

Prior art devices of this type have been directed to manual engagement and sequential rotation of a nut on a fastener element; see for example U.S. Pat. No. 4,765,210 having a power arm and a reaction arm.

Other prior art patents disclose wrench configurations for engagement and rotation of a nut-like surface such as a turnbuckle, see U.S. Pat. Nos. 3,772,943 and 3,682,023, for example.

Finally, a linear drive unit can be seen in U.S. Pat. No. 6,327,925.

It is believed that there are no known devices for rapidly rotating a nut along a threaded rod or shaft by use of a directed airstream.

SUMMARY OF THE INVENTION

An air driven tool for the engagement and rotational advancement of a threaded nut on an elongated threaded rod. A nut engagement driver having multiple spaced extending drive surfaces is registerably positioned on the outside surface of a threaded nut positioned on a threaded rod for advancement. A locking mechanism maintains nut engagement within the tool with an outside compressed airstream from a remote source being directed against the exposed drive surfaces sequentially so as to rotate the driver, thus advancing the nut along the threaded rod.

DETAILED DESCRIPTION OF THE INVENTION

Figure 1:
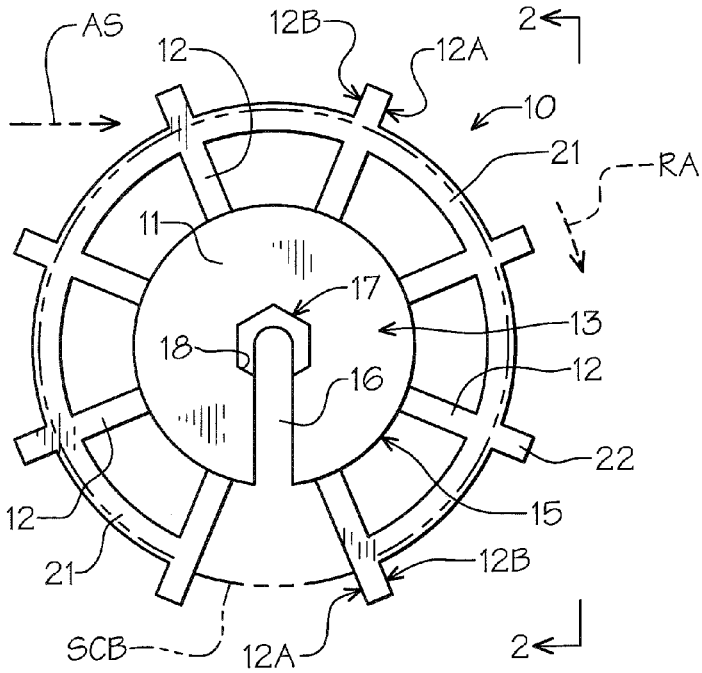
FIG. 1 is a top plan view of the nut runner of the invention.
Figure 2:
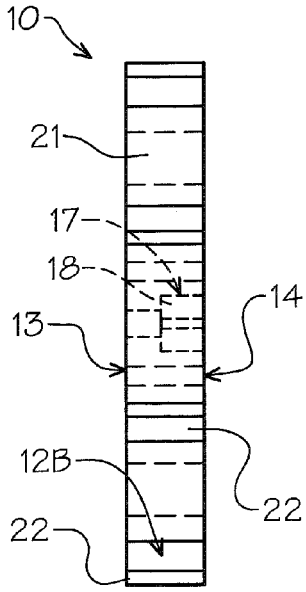
FIG. 2 is a side elevational view thereof.
Figure 3:
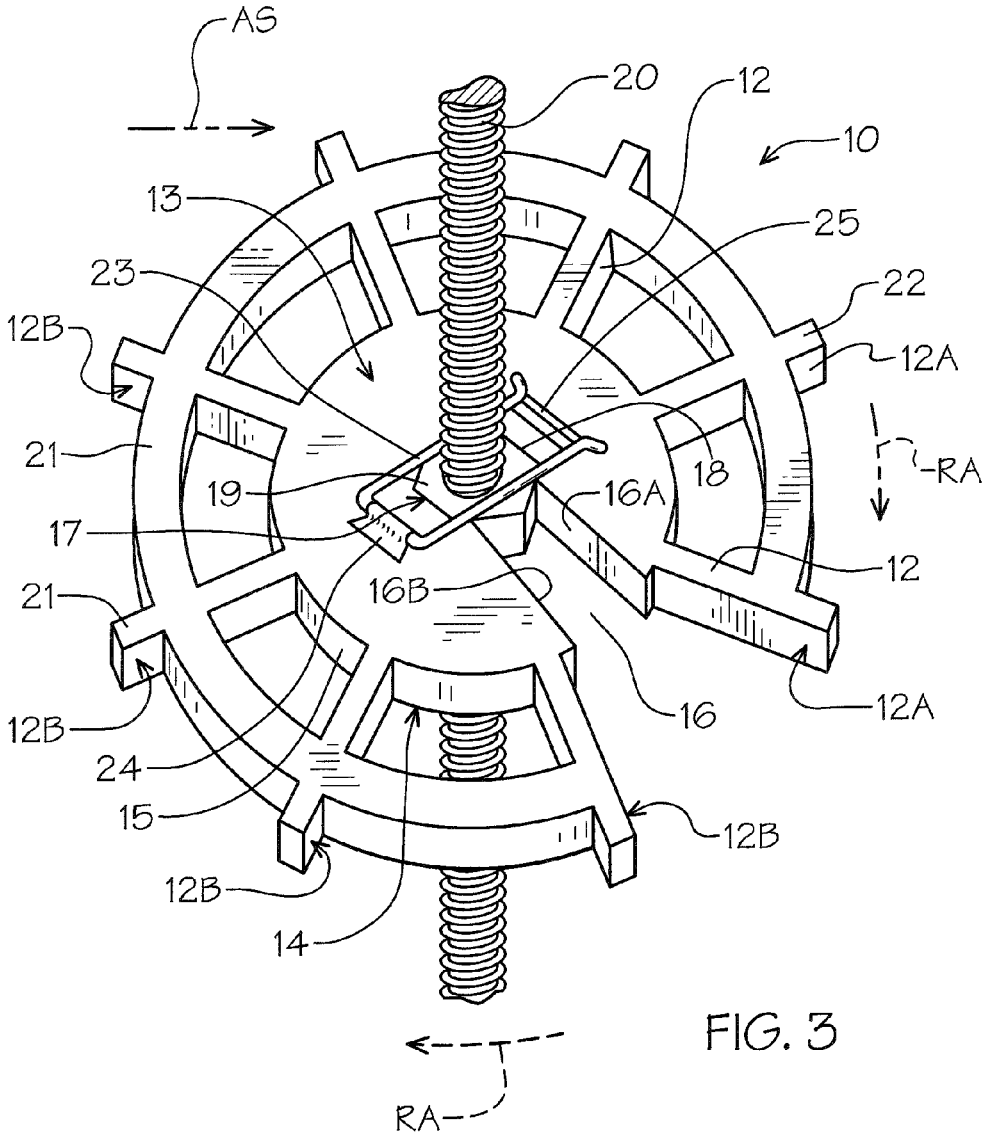
FIG. 3 is a perspective view of the nut runner in position for use engaging a nut on a threaded rod.

Referring to FIGS. 1-3 of the drawings, a nut runner 10 of the invention can be seen having a central annular body member 11 with a plurality of radially spaced drive arms 12 extending therefrom. The central body member 11 defines a disk configuration having a top surface 13, oppositely disposed spaced parallel bottom surface 14 and a perimeter depending annular sidewall 15.

An access slot 16 extends inwardly from the sidewall 15 terminating in a nut registration fitting opening 17 centrally therewithin. The nut registration opening 17 has multiple interengaging flat interior opposing wall surfaces 18 that corresponds with and provides registration with a threaded nut 19, best seen in FIG. 3 of the drawings. The access slot 16 has oppositely disposed spaced parallel side interengagement walls 16A and 16B defining a space dimension greater than that of the corresponding nut registration opening 17 to allow passage of a threaded rod 20 on which the nut 19 is engaged.

Each of the drive arms 12 is of equal transverse dimension and length providing multiple omni-directional drive flat end surfaces 12A and 12B thereon as will be described in greater detail hereinafter.

An annular stabilization and support band 21 interengages and interconnects each of the respective arms 12 in spaced relation to the perimeter sidewall 15. Each of the respective arms 12 has an end portion 22, having the drive slot end surfaces 12A and 12B as hereinbefore described, that extends beyond the corresponding support band 21.

Referring now to FIG. 3 of the drawings, the nut runner 10 of the invention can be seen "in use" engaged on the nut 19 threadably disposed on the corresponding threaded rod 20. A U-shaped retainment clip 23 used in this example is positioned on the top surface 13 of the body member 11 having a mounting sleeve 24 with a spaced locking engagement fitting 25 allowing for the respective ends of the retainer clip to engage and frictionally snap and be held thereby. It will be evident to those skilled in the art that a variety of alternate clip retainment fittings may be used so as to position a clip and hold same in place.

It will be seen, as in use, a directed energy stream of air AS indicated by directional force arrows can be applied to the arms 12 which will thereby spin the nut runner 10 rotating about the rod 20 advancing the so engaged threaded nut 19 thereon indicated in this example by rotational arrows RA.

Corresponding energy airstream AS will preferably impinge and drive respective defined drive surfaces 12A and 12B dependent on rotation requirement orientation of the airstream when engaged thereon.

Figure 4:
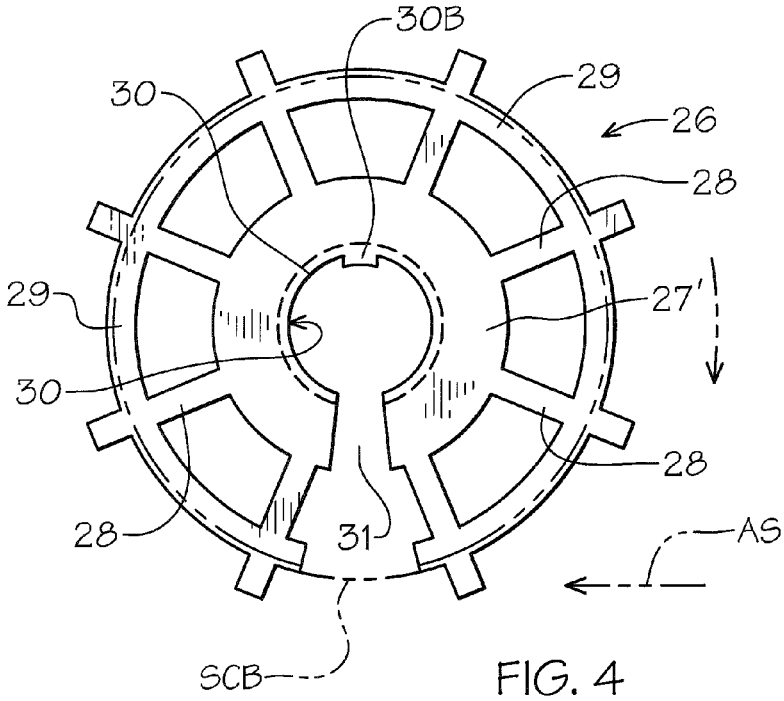
FIG. 4 is a top plan view of an alternate interchangeable size nut runner.
Figure 5:
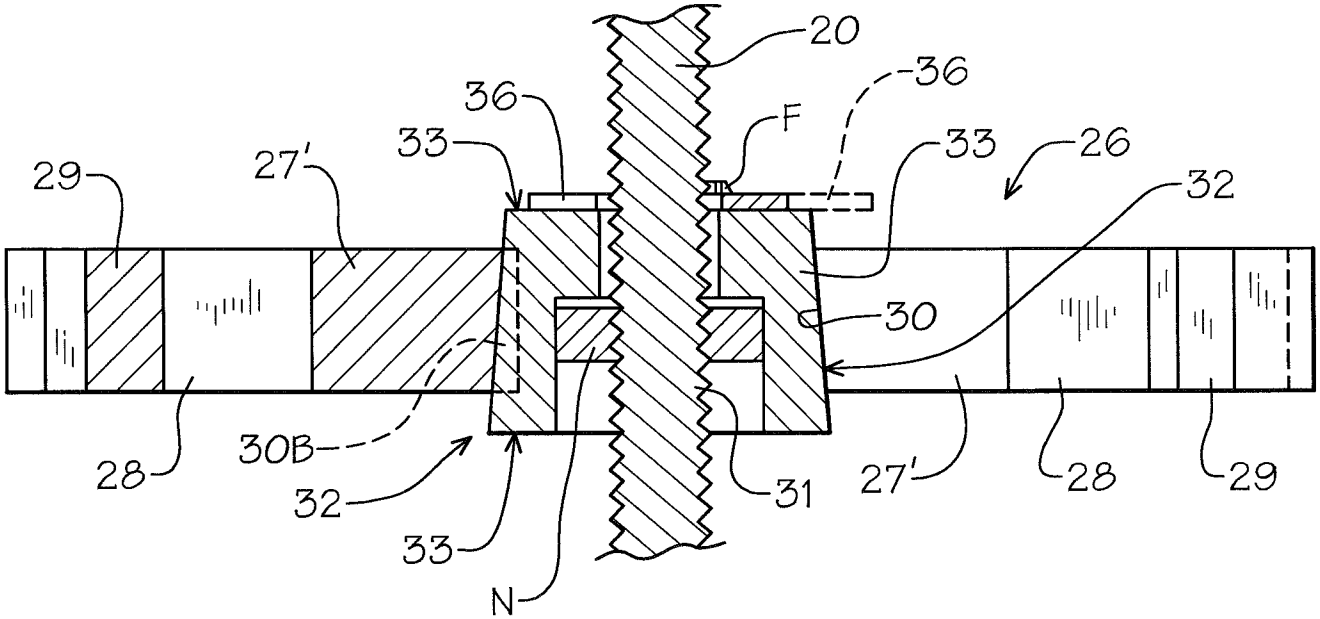
FIG. 5 is an enlarged partial sectional view of the alternate interchangeable size nut runner positioned on a nut to be advanced on a threaded rod.

Referring not to FIGS. 4 and 5 of the drawings, an alternate form of the nut runner 10 can be seen at 26 wherein a central annular disk 27 is provided with radially spaced drive arms 28 extending therefrom. An arm stabilization and support band 29 is also provided as illustrated in the hereinbefore preferred embodiment 10. The alternate form 26 of the nut runner, however, has an enlarged central opening at 30 with tapered inner wall surfaces 30A and indexing tab 30B with a rod access slot 31 in communication therewith. The central opening at 30 defines a universal mounting fitting for plurality of interchangeable nut engagement inserts 32, an example of which can be seen in FIGS. 6-8 of the drawings.

Each of the nut receiving inserts 32 has a tapered body member 33 with oppositely disposed upper and lower surfaces 33A and 33B and a rod access slot 34 with determined size nut engagement registration opening at 35 therewithin. The respective inserts 32 are therefore wedgeably secured within the central opening at 30 as best seen in FIG. 5 of the drawings providing by interchangeable inserts a number of different nut registration sizes therewithin.

Each of the inserts 32 have a centrifugal force activation safety so retainment bracket 36 which is slidably positioned on the top end surface 33A by fasteners F and is of a generally annular dimension with a central aperture and a cut-out at 37C extending therefrom.

The safety retainment bracket 36 has oppositely disposed elongated openings at 36A and 36B therewithin through which the fasteners F are engaged loosely retaining the bracket thereon.

Figure 6:
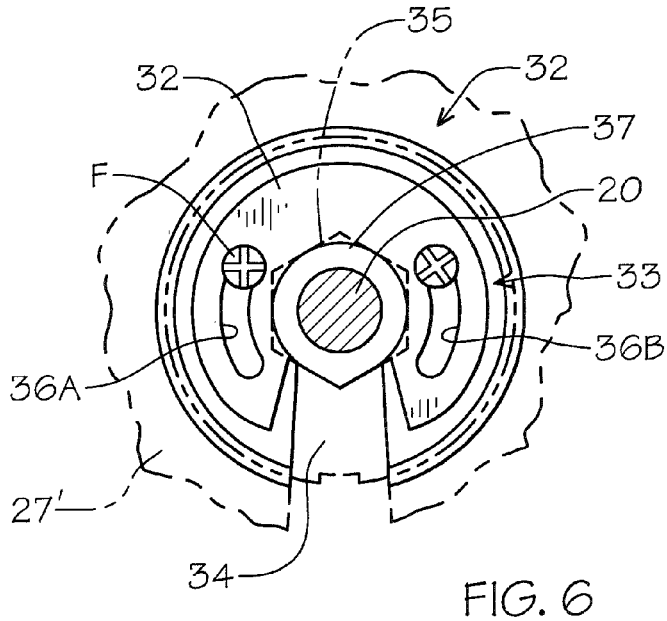
FIG. 6 is an enlarged top plan view of an interchangeable size nut engagement insert.
Figure 7:
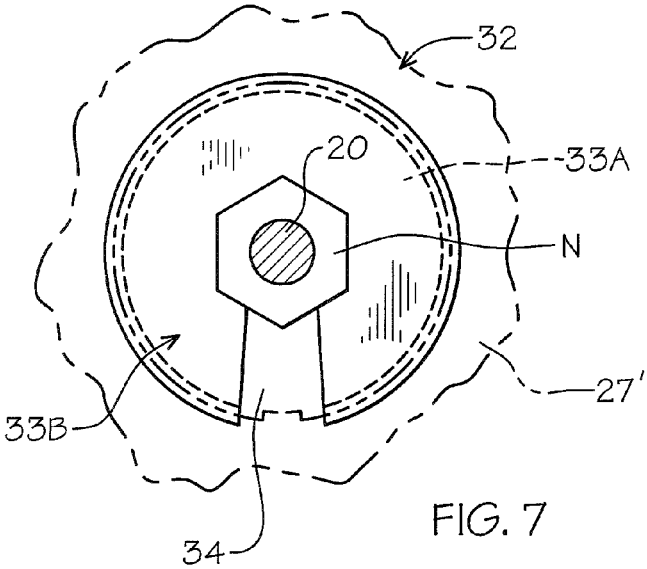
FIG. 7 is a bottom plan view thereof.
Figure 8:
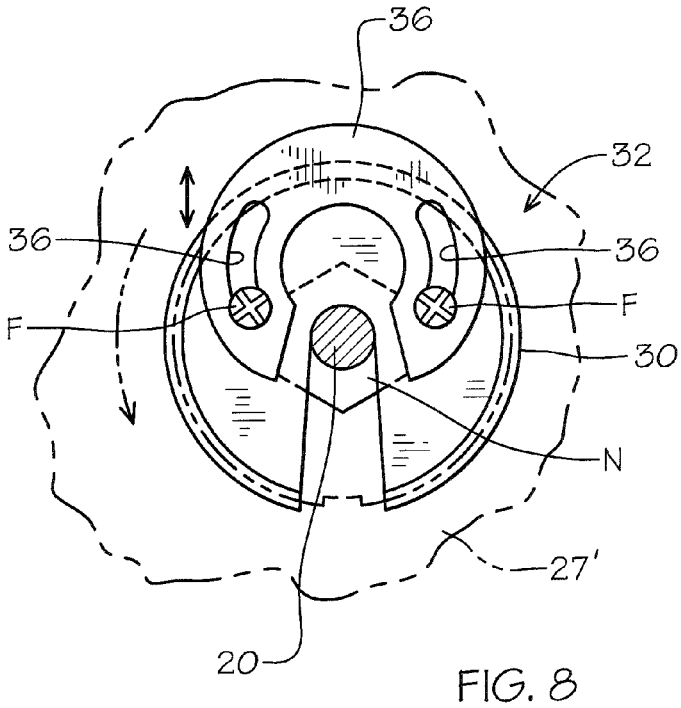
FIG. 8 is an enlarged top plan view with the interchangeable nut engagement insert with a centrifugal safety retainment latch extended as in engaged use position during rotation.

Referring now to FIGS. 6 and 8 of the drawings, the relative position of the retainment bracket 36 can be seen at rest in FIG. 6, centered on the nut/rod central opening 30 and in FIG. 8 illustrating the position achieved during rapid rotation sliding outwardly over the edge of the annular disk body member 27 represented, as noted, during rotation.

It will be seen that by having multiple interchangeable "size" inserts 32 replaceably and interchangeably inserted into the alternate nut runner 26 can as such be used as a universal unit with the size adaptable limitation determined only by the number and therefore the variety of different size inserts 32 available.

In use, both the primary and alternate form of nut runner is rotated by the use of an independent compressed air source AS indicated by broken arrows in FIGS. 1, 3 and 4 of the drawings directed in a force stream against the hereinbefore described end portions 12A and 12B of the respective drive arms 12 and 28 selectively, repeatedly, and directionally to impart rotation of the respective nuts 19 and 34 engaged therewithin for rapid advancement along their engaged threaded rod 20.

It will also be seen that the choice of materials will determine the requirement of certain structural aspects hereinbefore described. For example, the stabilization and support bands 20 and 29 would not be required for functionality when used with higher strength fabrication materials making the respective primary and alternate form of the invention arms 12 and 15 respectively strong enough to be self-supporting during a usable lifetime of the tool.

Additionally, given the advantages inherent of rotational mass kinetic energy the central annular body members 11 and alternate disk 27 may be enlarged to encompass the area defined by the support bands and its central spacing to be formed as a single continuous member indicated for illustration by the tri-broken lines SCM in FIGS. 1 and 4 of the drawings. Such increased mass of these central areas would impart additional rotational duration and also eliminate the need for reinforcing band for stronger arms as hereinbefore described.

It will thus be seen that a new and useful nut runner has been illustrated and described and it will be apparent to those skilled in the art that various changes and modifications may be made thereto without departing from the spirit of the invention.

Therefore I claim:

1. A nut rotator for a nut on a threaded rod comprising, a central nut engagement member, a plurality of drive arms extending radially from said nut engagement member, said nut engagement member having, a nut registration opening centrally therewithin, said nut engagement member comprising an annular disk, a rod access slot in communication with said nut registration opening and means for stabilizing said drive arms.

2. The nut rotator set forth in claim 1 wherein said nut receiving insert has a tapered exterior sidewall for registration within a corresponding tapered interior surface defined in central aperture of said apertured engagement member.

3. A nut rotator for a nut on a threaded rod comprising, a central apertured engagement member, a nut receiving insert positioned within said central apertured engagement member, a plurality of drive arms radially extending from said central apertured engagement member, a nut receiving insert selectively positioned within said apertured engagement member, a rod access slot in said nut receiving insert and said apertured engagement member and means for retaining said nut receiving insert therein during rotation thereof.

4. The nut rotator of claim 3 wherein said central apertured engagement member comprises, an annular disk.

5. The nut rotator set forth in claim 3 wherein said nut receiving insert has at least two parallel opposing wall surfaces therewithin for engagement on said nut.

6. The nut rotator set forth in claim 3 wherein said means for retaining said nut receiving insert in said central apertured engagement member during rotation comprises, sliding, slotted aperture plate movably positioned on said nut receiving insert centrally thereon, movable from a first position within the perimeter edge defined surface of said nut receiving insert to a second position beyond said perimeter surface during rotation.

* * * * *